US011480383B2

(12) United States Patent
Uslu et al.

(10) Patent No.: US 11,480,383 B2
(45) Date of Patent: Oct. 25, 2022

(54) DEVICE FOR DETECTING FORMATION OF WATER ICE

(71) Applicant: Vestel Elektronik Sanayi ve Ticaret A.S., Manisa (TR)

(72) Inventors: Mutlu Uslu, Manisa (TR); Nevzat Yalin, Manisa (TR)

(73) Assignee: VESTEL ELEKTRONIK SANAYI VE TICARET A.S., Manisa (TR)

( * ) Notice: Subject to any disclaimer, the term of this patent is extended or adjusted under 35 U.S.C. 154(b) by 0 days.

(21) Appl. No.: 17/615,054

(22) PCT Filed: May 30, 2019

(86) PCT No.: PCT/EP2019/064135
§ 371 (c)(1),
(2) Date: Nov. 29, 2021

(87) PCT Pub. No.: WO2020/239230
PCT Pub. Date: Dec. 3, 2020

(65) Prior Publication Data

US 2022/0205704 A1 Jun. 30, 2022

(51) Int. Cl.
*F25D 21/02* (2006.01)
*F25D 21/08* (2006.01)

(52) U.S. Cl.
CPC ..... *F25D 21/02* (2013.01); *F25D 21/08* (2013.01)

(58) Field of Classification Search
CPC ..... F25D 21/08; F25D 21/02
See application file for complete search history.

(56) References Cited

U.S. PATENT DOCUMENTS 2,679,731 A * 6/1954 Zearfoss, Jr. ..... F25D 21/02 337/365
3,063,249 A * 11/1962 Matthies ..... F25D 21/02 200/61.42

(Continued)

FOREIGN PATENT DOCUMENTS

EP 3355009 A1 8/2018
SU 407162 A1 11/1973

(Continued)

OTHER PUBLICATIONS

International Search Report and Written Opinion for Application No. PCT/EP2019/064135 dated Feb. 25, 2020 (11 pages).

*Primary Examiner* — Kun Kai Ma
(74) *Attorney, Agent, or Firm* — J. Miguel Hernandez; James R. Gourley; Carstens & Cahoon, LLP

(57) ABSTRACT

Device for detecting formation of water ice on a substrate has a first permanent magnet and a second permanent magnet. The magnets are spaced apart and arranged with a north pole of one magnet opposed to a south pole of the other magnet. A container contains a body of water within the space between the permanent magnets. At least one of the magnets is movable in the container. A heat conductor arrangement conducts heat between the substrate and the body of water the container. As heat is conducted from the body of water in the container to the substrate and the temperature of the body of water decreases below the temperature at which the density of water is a maximum, the volume of the body of water increases which drives the first and second permanent magnets apart from each other.

10 Claims, 2 Drawing Sheets

(56) References Cited

U.S. PATENT DOCUMENTS

| | | | | | |
|---|---|---|---|---|---|
| 3,134,238 | A | * | 5/1964 | Matthies | F25D 21/02 62/214 |
| 3,229,474 | A | * | 1/1966 | Wilson | F25D 21/02 62/151 |
| 3,321,928 | A | * | 5/1967 | Thorner | F25D 21/02 62/154 |
| 3,350,894 | A | * | 11/1967 | Thorner | F25D 21/02 60/527 |
| 3,373,575 | A | * | 3/1968 | Nelson | F25D 21/02 340/581 |
| 3,726,105 | A | | 4/1973 | Auracher | |
| 4,347,709 | A | | 9/1982 | Wu et al. | |
| 6,321,555 | B1 | | 11/2001 | Buratti et al. | |

FOREIGN PATENT DOCUMENTS

| | | | |
|---|---|---|---|
| SU | 1763825 | A1 | 9/1992 |
| WO | 0186215 | A2 | 11/2001 |

* cited by examiner

DEVICE FOR DETECTING FORMATION OF WATER ICE

CROSS REFERENCE TO RELATED APPLICATION

This application is a US 371 application from PCT/EP2019/064135 entitled "DEVICE FOR DETECTING FORMATION OF WATER ICE" filed on May 30, 2019 and published as WO 2020/239230 A1 on Dec. 3, 2020. The technical disclosures of every application and publication listed in this paragraph are hereby incorporated herein by reference.

TECHNICAL FIELD

The present disclosure relates to a device for detecting formation of water ice.

BACKGROUND

There are many devices and apparatus that are susceptible to freezing or frosting, that is, devices and apparatus that are susceptible or prone to a build up of ice on some part of the device or apparatus. Some examples include refrigeration apparatus, including specifically freezers and refrigerators and the like, air conditioning units, etc.

So-called frost-free refrigeration apparatus, such as freezers and refrigerators and the like, employ various methods for preventing a build-up of ice. One example of such a method is periodically heating the freezer or refrigerator to melt any ice that may have formed inside. For example, a part of the freezer or refrigerator that is susceptible to ice build-up may be heated for 5 or 10 minutes or so every 8 or 10 hours or so. This process can be wasteful and inefficient as it has no regard to whether ice has actually formed.

Other examples of frost-free refrigeration apparatus rely on one or more electronic sensors, which may measure for example temperature and humidity, and a microcontroller which determines when defrosting is required based on outputs of the sensors. Such arrangements are complex, require programming of the microcontroller, and may not be reliable.

SUMMARY

According to an aspect disclosed herein, there is provided a device for detecting formation of water ice on a substrate, the device comprising:

a first permanent magnet;

a second permanent magnet;

the first and second permanent magnets being spaced apart and arranged with a north pole of one magnet opposed to a south pole of the other magnet such that the first and second permanent magnets are normally attracted to each other;

a container which contains a body of water within the space between the permanent magnets;

at least one of the permanent magnets being movable in the container relative to the other of the permanent magnets; and a heat conductor arrangement for conducting heat between a said substrate and the body of water in the container;

whereby as heat is conducted in use from the body of water in the container to a said substrate by the heat conductor arrangement and the temperature of the body of water decreases below the temperature at which the density of water is a maximum, the volume of the body of water increases which drives the first and second permanent magnets apart from each other.

Such a device does not require electronic sensors or a microcontroller or other processor or the like to detect formation of ice or to control a defrosting process. The device can therefore be relatively simple and inexpensive to manufacture.

In an example, the container which contains the body of water is thermally insulative.

In an example, the device comprises a switch which is caused to operate when the first and second permanent magnets have been driven such that the distance between the first and second permanent magnets exceeds a threshold distance.

In an example, the threshold distance is such that the switch is operated only when the body of water in the container freezes.

In an example, the switch comprises a first electrical conductor and a second electrical conductor, the first electrical conductor being fixed relative to the movable permanent magnet so as to move with the movable permanent magnet, the second electrical conductor being fixed relative to the other permanent magnet, whereby the first electrical conductor and the second electrical conductor are brought into contact with each other to operate the switch when the distance between the first and second permanent magnets exceeds the threshold distance.

In this example, the first and second electrical conductors may form an electrically resistive heater when brought into contact with each other, which can be used to provide heat to defrost the substrate. That is, the device can detect formation of ice on the substrate and automatically carry out a defrost process to thaw the ice when ice is detected.

There is also provided apparatus comprising:

a substrate which is susceptible to frosting; and a device as described above;

wherein the heat conductor arrangement of the device is in thermal contact with the substrate to conduct heat between the substrate and the body of water in the container of the device.

In an example where the device comprises a switch as described above, the device is arranged such that operation of the switch causes a heater to operate to defrost the substrate.

In an example where the device is arranged such that operation of the switch causes a heater to operate as described above, the heater may be provided by the first electrical conductor and the second electrical conductor of the device.

In an example, the apparatus comprises a second heat transfer arrangement for transferring heat from the first and second electrical conductors to the substrate when electrical power passes through the first and second electrical conductors when the first and second electrical conductors are brought into contact with each other.

In an example, the apparatus is a refrigeration apparatus, the substrate being a pipe which carries refrigerant through the refrigeration apparatus.

BRIEF DESCRIPTION OF THE DRAWINGS

To assist understanding of the present disclosure and to show how embodiments may be put into effect, reference is made by way of example to the accompanying drawings in which.

DETAILED DESCRIPTION

The term "refrigeration apparatus" will be used herein specifically to include freezers and refrigerators and the like. The term "refrigeration apparatus" as used herein may also include air conditioning units and other devices or apparatus that are susceptible to frosting, including in particular devices or apparatus that rely on the flow of a refrigerant, unless the context requires otherwise.

In examples of the present disclosure, a device for detecting formation of water ice on a substrate is provided which uses the magnetic force of permanent magnets and the fact that water expands as its temperature drops below (approximately) 4° C. and/or as the water freezes to form ice at 0° C. The device does not require electronic sensors or a microcontroller or other processor or the like to control the defrosting process. In some examples, the device also provides a switch to operate a heater and/or the device itself may operate as a heater.

Figure 1:
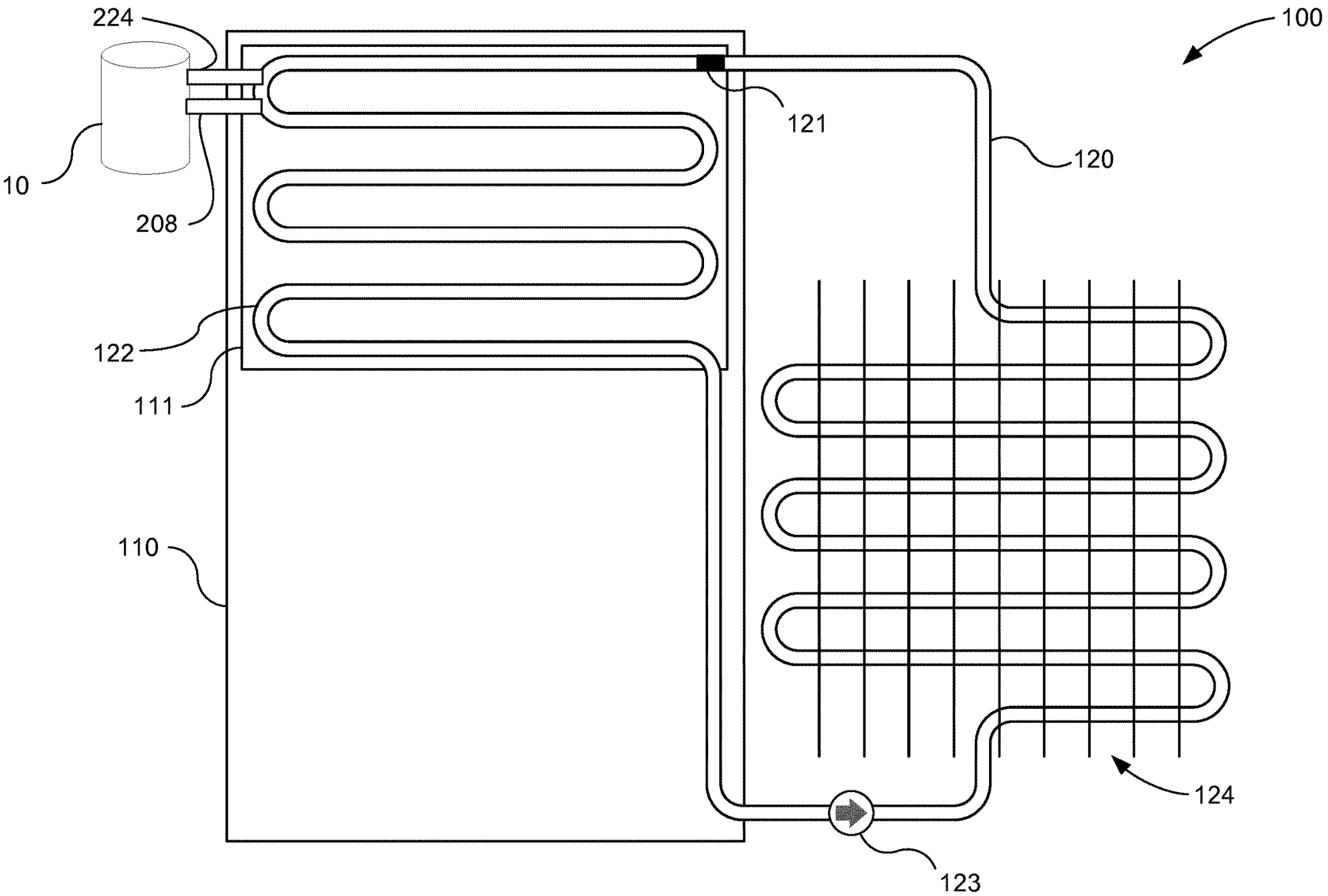
FIG. 1 shows schematically an example of a device according to an embodiment of the present disclosure and an example of a refrigeration apparatus; and, FIG. 2 shows schematically a more detailed and partially phantom view of the device of FIG. 1.

Referring now to the drawings, FIG. 1 shows schematically an example of a device 10 according to an embodiment of the present disclosure connected to an example of a refrigeration apparatus 100. In this example, the refrigeration apparatus 100 is a refrigerator or a freezer. In some examples, the refrigeration apparatus may be an air conditioning unit or some other apparatus that is susceptible to freezing or has parts that are susceptible to freezing.

The refrigeration apparatus 100 implements a vapour-compression refrigeration cycle to cool a space 110 within the refrigeration apparatus 100. Specifically, in this example the vapour-compression refrigeration cycle (described in more detail below) is implemented to cool a freezer portion 111 of the space 110 to below 0° C. Other portions of the space 110 will also be cooled depending on the temperature of the freezer portion 111 and the layout of the refrigeration apparatus 100. In any event, the freezer portion 111 represents a subsection of the space 110 in which substances, such as foodstuffs, etc., may be placed to freeze them. More generally, the vapour-compression refrigeration cycle may be used to cool a space 110 of a refrigeration apparatus 100 even if the refrigeration apparatus 100 does not have a freezer portion as such.

The refrigeration apparatus 100 comprises a closed circuit of tubing 120 containing a selected refrigerant for cooling the interior of a space 110 (e.g. a foodstuff-storing portion of a refrigeration apparatus). Specifically, the circuit of tubing 120 includes an internal section 122 located within the freezer portion 111 and an external section 124 located outside the space 110.

The refrigerant is selected having a temperature of vaporisation such that it will vaporise in the internal section 122 as it absorbs heat from the interior of the freezer portion 111. For this reason, the internal section 122 is often referred to as an evaporator 122.

A compressor 123 is provided to compress the vaporised refrigerant and so raise its temperature significantly. The high pressure, high temperature refrigerant vapour passes from the compressor 123 through the "hot" external section 124 of the circuit 120. The external section 124 acts as a condenser in the refrigeration cycle, transferring heat to the environment (e.g. the room in which the refrigeration apparatus 100 is located). A heatsink or fan may be provided to improve the transfer of heat. The transfer of heat causes at least some of the refrigerant vapour in the external section 124 to condense back to a liquid form.

The high pressure refrigerant, now cooled and at least partially in liquid form, passes to an expansion valve 121 which reduces the pressure of the refrigerant, causing it to expand and cool. The low pressure low temperature refrigerant then passes through the evaporator 122 within the freezer portion 111, acting as an evaporator in the refrigeration cycle, to absorb heat from the interior of the freezer portion 111. As a result, the cool refrigerant liquid passing through the evaporator 122 vaporises before passing on to the compressor 123 to complete the refrigeration cycle.

The compressor 123 may be driven by a low power DC motor, selected according to the refrigerant vapour pressure and temperature required in the external section 124 of the circuit and the rate of cooling required by the evaporator 122 of the circuit.

Because of the low temperatures generated within the freezer portion 111 by the evaporator 122 of the tubing 120, humidity from the air may freeze to the evaporator 122, causing an ice layer to build up over time. The ice build-up (also called "frost") on the evaporator 122 and/or in other parts of the refrigeration apparatus 100 is undesirable because it occupies space within the freezer portion 111 or other parts of the refrigeration apparatus 100, which could otherwise be used for storage (e.g. of foodstuffs) and reduces the efficiency of the refrigeration apparatus 100. A user of the refrigeration apparatus may manually "defrost" the refrigeration apparatus 100 periodically by allowing the freezer portion 111 to heat up to a point at which the ice melts, and then removing the resulting liquid water.

Some known refrigeration apparatus have an arrangement, such as a heating resistor or other heating element, for heating up the freezer portion briefly in order to melt the ice layer and thereby defrost the freezer portion. In such known refrigeration apparatus, the defrost process may be performed automatically and periodically on a cycle, irrespective of how much frost has actually built up on the evaporator. This process can be wasteful and inefficient as it has no regard to whether ice has actually formed. Other examples of frost-free refrigeration apparatus rely on one or more electronic sensors, which may measure for example temperature and humidity, and a microcontroller which determines when defrosting is required based on outputs of the sensors. Such arrangements are complex, require programming of the microcontroller, and may not be reliable.

According to an example of the present disclosure, the device 10 is used to detect formation of ice or "frost" on some part of the refrigeration apparatus 100. In this example, the device 10 is used specially to detect formation of ice on the evaporator 122 but can be used to detect formation of ice on other parts. This example of the device 10 does not require electronic sensors or a controller or the like.

Figure 2:
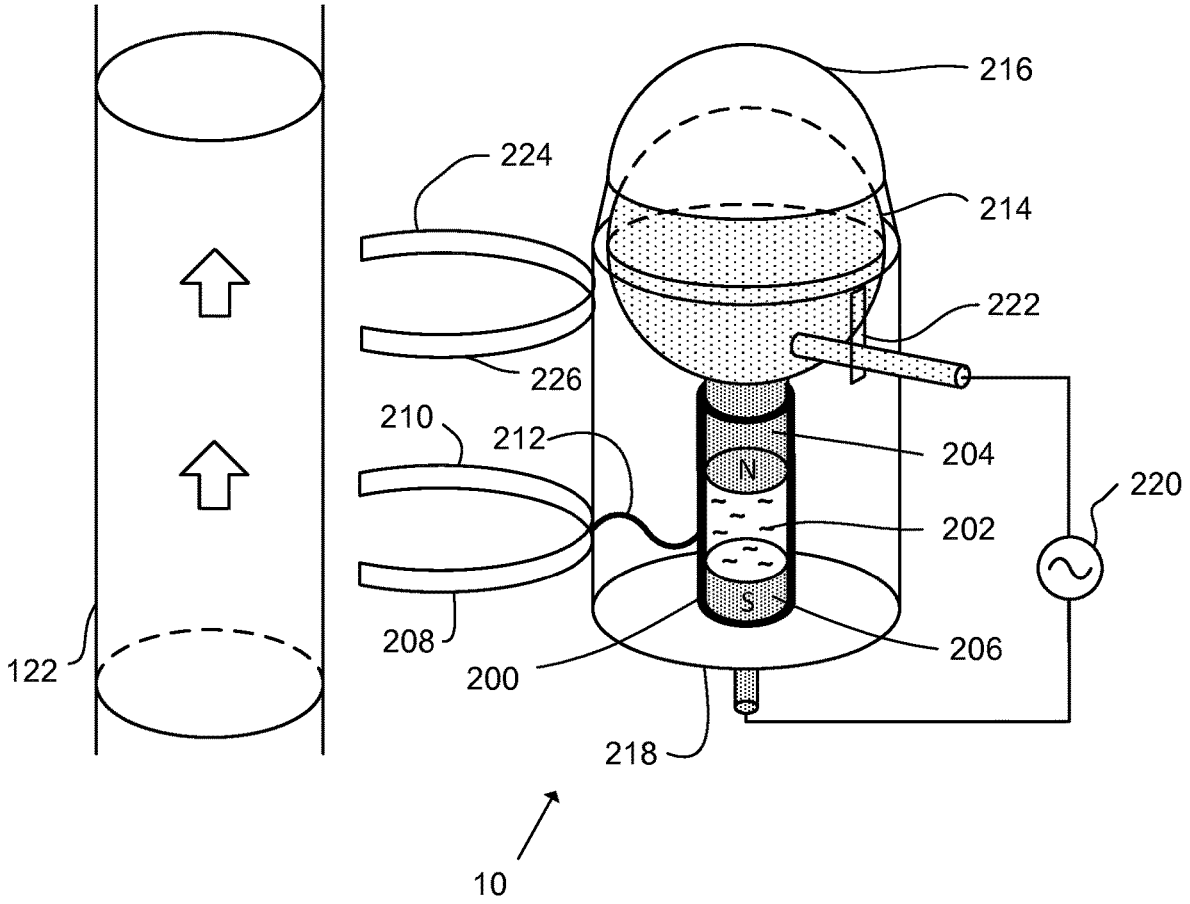

Referring particularly to FIG. 2, this shows schematically a more detailed and partially phantom view of the device 10. The device 10 has a container 200 which contains a body of water 202. The container 200 is a hollow cylinder. The walls of the container 200 are thermally insulative. The container 200 may be made of for example a plastics material.

The container 200 houses two permanent magnets 204, 206. The magnets 204, 206 are spaced from each other by the body of water 202. The magnets 204, 206 are arranged such that opposite poles are opposed to each other. That is, a north pole of one magnet 204 is opposed to the south pole of the other magnet 206. The magnets 204, 206 therefore tend to attract each other. At least one of the magnets 204, 206 is movable within the container 200. In the example shown, the magnet 204 that is uppermost in the drawing is movable within the container 200. (References here to "upper" and "lower" and the like are for convenience when referring to the drawings. In general, the device 10 may be arranged in other orientations, though the vertical orientation with the upper magnet 204 being movable vertically up and down is likely to be most convenient and effective.) In this example, the other magnet 206 is fixed against movement within the container 200. Accordingly, normally, the magnets 204, 206 are biased towards each other by magnetic attraction, which pulls the magnets 204, 206 together, the magnets 204, 206 being held apart by the body of water 202.

The device 10 is in thermal communication with the substrate or part that is susceptible to frosting, which, in this example, is the evaporator 122 of the refrigeration apparatus 100. Specifically, the body of water 202 is in thermal communication with the evaporator 122. In the example shown, this is achieved by a first heat conductor arrangement 208 extending between the body of water 202 and the evaporator 122. In the example shown, the heat conductor arrangement 208 is formed of metal rods or the like of high thermal conductivity such as copper or aluminium, etc. In this specific example, the heat conductor arrangement 208 has a clamp portion 210 formed of two clamp arms which extend out from the body of the device 10 and which can be clamped around the evaporator 122. A further heat conductor 212, which again may be formed of a metal or the like of high thermal conductivity, extends from the clamp portion 210 into the body of the device 10 and makes thermal contact with the body of water 202. The heat conductor 212 may for example pass through an aperture or through hole in the wall of the container 200 to contact the water 202. As an alternative, the wall of the container 200 (which is generally thermally insulative) may have a thermally conductive panel or insert or the like and the heat conductor 212 is contact with that thermally conductive part.

In use, if and when ice forms on the evaporator 122, heat is conducted by the heat conductor arrangement 208 and heat conductor 212 out of the water 202 in the container 200. This causes the temperature of the water 202 to drop. As is known, water is somewhat unusual in that water has a maximum density at (approximately) 4° C., which is somewhat above its freezing point of 0° C. (at standard pressure). Accordingly, as the temperature of the water 202 in the container 200 drops below around 4° C., the volume of the water 202 increases. This drives the permanent magnets 204, 206 apart. Further, as again is known, as water freezes to form ice at 0° C., the volume increases fairly significantly, by around 9% or so. Accordingly, as the temperature of the water 202 in the container 200 drops to 0° C., the freezing of the water 202 drives the permanent magnets 204, 206 apart by a relatively large amount (in particular, increasing the separation by up to around 9% or so if, as is preferred, the walls of the container 200 are rigid). In any event, this movement apart of the permanent magnets 204, 206 can be taken as an indication that ice has formed on the evaporator 122. It may be noted that this is achieved without requiring (electronic or similar) temperature sensors, humidity sensors, etc.

The device 10 described so far therefore operates to detect formation of ice on the substrate, which in this example is the evaporator 122 of the refrigeration apparatus 100. The device 10 may further be arranged so that heating of the evaporator 122 is then carried out so as to melt or thaw the ice on the evaporator 122. For this, the device 10 can be arranged such that movement of the movable magnet 204 through a threshold distance operates a switch. The threshold distance may be small, corresponding for example to the temperature of the water 202 dropping to somewhere between 4° C. and 0° C. Alternatively, the threshold distance may be somewhat larger, corresponding for example to the temperature of the water 202 dropping to 0° C. and therefore when the water 202 has frozen.

For this, the device 10 has two electrical conductors 214, 216. The two electrical conductors 214, 216 may be formed of for example metal, such as for example nichrome (NiCr, nickel-chrome), cupronickel or copper-nickel (CuNi), etc. A first of the electrical conductors 214 is fixed relative to the movable magnet 204 (for example, by being directly connected to the movable magnet 204) so as to move with the movable magnet 204. The second electrical conductor 216 is fixed relative to the other magnet 206. The second electrical conductor 216 is arranged to be opposed to the first electrical conductor 214 and in the path of movement of the first electrical conductor 214. Moreover, the two electrical conductors 214, 216 are normally spaced apart from each other when the temperature of the water 202 is relatively high (which indicates that ice has not formed on the evaporator 122). The distance between the electrical conductors 214, 216 is such that as the temperature of the water 202 drops, and in an example such that as the water 202 freezes, the movement of the movable magnet 204 drives the first, movable electrical conductor 214 into contact with the second electrical conductor 216. This contact between the two electrical conductors 214, 216 can have the effect of closing a switch.

For example, the two electrical conductors 214, 216 may be part of an electrical circuit which is connected to a heater (not shown) which is in contact with or at least in the neighbourhood of the evaporator 122. As the two electrical conductors 214, 216 contact each other, this can be used so switch on the heater, which in turn melts ice that has formed on the evaporator 122.

In another example, the device 10 itself may provide an electrically resistive heater for melting ice that has formed on the evaporator 122 when the two electrical conductors 214, 216 are brought into contact with each other. For example, the two electrical conductors 214, 216 may be connected to opposite sides of a power source to form an electrical circuit with the power source. As the two electrical conductors 214, 216 are brought into contact with each other, this closes the circuit, thus allowing electrical power to pass through the two electrical conductors 214, 216 to heat the two electrical conductors 214, 216.

In another example which is indicated in FIG. 2, the device 10 has a main external housing 218 which is formed of an electrically conductive material, which may be the same material as used for the two electrical conductors 214, 216. The container 200 for the water 202 and the two permanent magnets 204, 206 is fixed within the housing 218. A source 220 of electrical power is connected to the housing 218 at one side and to the first (movable) electrical conductor 214 at the other side. The power source 220 may ultimately derive power from an AC mains power supply. The connection of the power source 220 to the first electrical conductor 214 is through an elongate slot 222 in a wall of the housing 218 so that the connection can be maintained as the first electrical conductor 214 moves back and forth within the housing 218. When the two electrical conductors 214, 216 are brought into contact with each other, this closes the circuit with the power source 220. In this example, the causes the housing 218 and the first and second electrical conductors 214, 216 to heat up.

In either of these last two examples, as the first and second electrical conductors 214, 216 and optionally the housing 218 heat up, this heat is used to melt the ice on the evaporator 122.

To transfer heat from the first and second electrical conductors 214, 216 and optionally the housing 218 to the evaporator 122 in these last two examples, a number of options are available. In one example, the device 10 is simply placed close to the evaporator 122 so that the heat is transferred by convection. Alternatively or additionally, the device 10 may have a second heat conductor arrangement 224, which extends between the housing 218 and the evaporator 122. Like the first heat conductor arrangement 208, the second heat conductor arrangement 224 may have a clamp portion 226 formed of two clamp arms which extend out from the device 10 and which can be clamped around the evaporator 122. This enables heat to pass by conduction to the evaporator 122, which may provide for faster and more efficient thawing of the ice. There may be several such second heat conductor arrangements for passing heat to the evaporator 122. This may be particularly useful if there are several particular parts of the evaporator 122 that are susceptible to frosting as the heat can be directed more specifically to those parts. On the other hand, there may be cases where it is better to provide a more general heating of the evaporator 122. In that case, there may be no thermal conduction of heat to the evaporator 122 and instead the heat transfer is by convection.

In any event, once the ice on the evaporator 122 has melted and its temperature rises above 0° C., heat is transferred by the first heat conductor arrangement 208 from the evaporator 122 to the body of "water" 202 (which is currently ice) in the container 200. This melts the ice 202 in the container 200, causing its volume to reduce. The attractive force between the two magnets 204, 206 pulls the movable magnet 204 towards the fixed magnet 206, which breaks the contact between the two electrical conductors 214, 216. This causes the heater to switch off, whether this is an external heater or is provided by the device 10.

The device 10 therefore provides for detection of formation of ice on a substrate, which in this example is an evaporator 122 of a refrigeration apparatus but which in other examples may be another part or component of a refrigeration apparatus or other apparatus. This is achieved without requiring electronic sensors or a microcontroller or other processor or the like. In an example, the device 10 also provides a heater for heating the ice so as to melt the ice, or at least provides a switch for a heater, which is automatically switched on to melt the ice when formation of ice on the substrate is detected.

In the example shown, the first electrical conductor 214 is in the form of a sphere, or at least a hemisphere, and the second electrical conductor 216 is correspondingly hemispherical. This provides for a broad, large contact area between the first and second electrical conductors 214, 216. Alternatively, the first and second electrical conductors 214, 216 may another shape, such as cylindrical.

The device 10 has been described principally for use in detecting ice formation on and defrosting an evaporator 122 of a refrigeration apparatus 100 such as a refrigerator or a freezer. As noted, the device 10 may be used in other applications, including for example air conditioner units or other apparatus that have heat exchangers or other parts prone to icing.

Furthermore, the device 10 has been described for the example where the liquid 202 in the container 200 is water. As will be appreciated, this relies on one of the so-called "anomalous" properties of water, namely that the volume of a fixed mass of water increases as it freezes, rather than decreases which is more common. There are other materials whose volume increases as they freeze or at least as the temperature drops from one certain temperature to another even if the material does not freeze. Such materials include molten silica, silicon, gallium, germanium, antimony and bismuth. It may be possible to use such materials in the container 200 instead of or in addition to water, depending on the specific application and the relevant temperatures.

The examples described herein are to be understood as illustrative examples of embodiments of the invention. Further embodiments and examples are envisaged. Any feature described in relation to any one example or embodiment may be used alone or in combination with other features. In addition, any feature described in relation to any one example or embodiment may also be used in combination with one or more features of any other of the examples or embodiments, or any combination of any other of the examples or embodiments. Furthermore, equivalents and modifications not described herein may also be employed within the scope of the invention, which is defined in the claims.

The invention claimed is:

1. A device for detecting formation of water ice on a substrate, the device comprising:

a first permanent magnet;

a second permanent magnet;

the first and second permanent magnets being spaced apart and arranged with a north pole of one magnet opposed to a south pole of the other magnet such that the first and second permanent magnets are normally attracted to each other;

a container which contains a body of water within the space between the first and second permanent magnets;

at least one of the first and second permanent magnets being movable in the container relative to the other of the first and second permanent magnets; and a heat conductor arrangement for conducting heat between a said substrate and the body of water in the container;

whereby as heat is conducted in use from the body of water in the container to a said substrate by the heat conductor arrangement and the temperature of the body of water decreases below the temperature at which the density of water is a maximum, the volume of the body of water increases which drives the first and second permanent magnets apart from each other.

2. The device according to claim 1, wherein the container which contains the body of water is thermally insulative.

3. The device according to claim 1, comprising a switch which is caused to operate when the first and second permanent magnets have been driven such that the distance between the first and second permanent magnets exceeds a threshold distance.

4. The device according to claim 3, wherein the threshold distance is such that the switch is operated only when the body of water in the container freezes.

5. The device according to claim 3, wherein the switch comprises a first electrical conductor and a second electrical conductor, the first electrical conductor being fixed relative to the movable permanent magnet so as to move with the first permanent magnets, the second electrical conductor being fixed relative to the second permanent magnet, whereby the first electrical conductor and the second electrical conductor are brought into contact with each other to operate the switch when the distance between the first and second permanent magnets exceeds the threshold distance.

6. An apparatus comprising:

the device according to claim 1;

the substrate which is susceptible to frosting; and wherein the heat conductor arrangement of the device is in thermal contact with the substrate to conduct heat between the substrate and the body of water in the container of the device.

7. The apparatus according to claim 6, wherein the device comprises a switch which is caused to operate when the first and second permanent magnets have been driven such that the distance between the first and second permanent magnets exceeds a threshold distance;

wherein the device is arranged such that operation of the switch causes a heater to operate to defrost the substrate.

8. The apparatus according to claim 7, wherein the switch comprises a first electrical conductor and a second electrical conductor, the first electrical conductor being fixed relative to at least one of the first and second permanent magnets so as to move with the first permanent magnet, the second electrical conductor being fixed relative to the second permanent magnet, whereby the first electrical conductor and the second electrical conductor are brought into contact with each other to operate to switch when the distance between the first and second permanent magnets exceeds the threshold distance; and the heater being provided by the first electrical conductor and the second electrical conductor of the device.

9. The apparatus according to claim 8, comprising a second heat transfer arrangement for transferring heat from the first and second electrical conductors to the substrate when electrical power passes through the first and second electrical conductors when the first and second electrical conductors are brought into contact with each other.

10. The apparatus according to claim 6, wherein the apparatus is a refrigeration apparatus, the substrate being a pipe which carries refrigerant through the refrigeration apparatus.

* * * * *